US006801743B2

(12) United States Patent
Yano

(10) Patent No.: US 6,801,743 B2
(45) Date of Patent: Oct. 5, 2004

(54) IMAGE FORMING APPARATUS WITH TRANSFERRING MEMBER HAVING ION CONDUCTIVITY

(75) Inventor: Hideyuki Yano, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/854,677

(22) Filed: May 15, 2001

(65) Prior Publication Data

US 2002/0006294 A1 Jan. 17, 2002

(30) Foreign Application Priority Data

May 16, 2000 (JP) ..... 2000-143473

(51) Int. Cl.[7] ..... G03G 15/16
(52) U.S. Cl. ..... 399/310; 399/313
(58) Field of Search ..... 399/310, 312, 399/313, 303

(56) References Cited

U.S. PATENT DOCUMENTS 5,153,654 A 10/1992 Yuminamochi et al. ..... 355/271
5,177,549 A 1/1993 Ohtsuka et al. ..... 355/208
5,264,902 A 11/1993 Suwa et al. ..... 29/130
5,930,556 A * 7/1999 Imamiya ..... 399/66
5,974,281 A 10/1999 Fujii et al. ..... 399/302
6,026,268 A 2/2000 Shiozawa et al. ..... 399/99
6,167,230 A * 12/2000 Kimura et al.
6,411,785 B1 * 6/2002 Ogawahara et al. ..... 399/69

FOREIGN PATENT DOCUMENTS

EP 0 962 667 A1 * 12/1999
JP 9-222809 * 8/1997
JP 11-65318 * 3/1999
JP 11-109768 * 4/1999
JP 11-231662 * 8/1999
JP 11-327326 * 11/1999
JP 2000-143473 * 5/2000
JP 2001-117390 * 4/2001
JP 2001-154498 * 6/2001

* cited by examiner

*Primary Examiner*—Quana Grainger
(74) *Attorney, Agent, or Firm*—Fitzpatrick, Cella, Harper & Scinto

(57) ABSTRACT

An object of the present invention is to provide an image forming apparatus that has an image bearing body for bearing a toner image, a conveying member for bearing and conveying a recording material, and a transferring member for transferring a toner image on the image bearing body to the recording material conveyed by the conveying member by the application of a voltage, wherein the transferring member has ion conductivity.

15 Claims, 3 Drawing Sheets

IMAGE FORMING APPARATUS WITH TRANSFERRING MEMBER HAVING ION CONDUCTIVITY

BACKGROUND OF THE INVENTION

1. Field of the Invention

The present invention relates to an image forming apparatus such as a copying machine and a printer, and in particular to a transferring member of an in-line type image forming apparatus utilizing an electrophotographic method.

2. Related Background Art

In recent years, an image forming apparatus such as an electrophotographic apparatus has been developed which is capable of realizing high speed and high performance and capable of forming a color image, and various types of printers are on the market.

Among these printers, there is an in-line type image forming apparatus that multiply transfers a plurality of colors of toner images formed on a plurality of stations to a sheet one after another while conveying a sheet as a recording medium by conveying means of a belt shape. This in-line type image forming apparatus is considered to become a main color printer because it can form a color image at a high speed.

An in-line type image forming apparatus is classified into an image forming apparatus of a type that multiply transfers an image on an intermediate transferring member and a sheet attracting type image forming apparatus that attracts a sheet on a transfer belt to multiply transfer an image on the sheet. It is advantageous to employ the sheet attracting type image forming apparatus having less system components in order to realize miniaturization of an apparatus and reduce costs.

Recently, from the viewpoint of realizing high performance of a printer, diversification of recording media, so that recording materials of various sizes and thicknesses (basis weights), light transmittable (permeable) resin for projection by an overhead projector (OHT) and the like can be used, and further the necessity of double-side printing and the like are required more than ever.

In addition, from the standpoint of an environment in which a printer is used, it is desired that a favorable output image be realized not only in an office that is typically fully equipped with air-conditioning but also in various environments such as in a general office and at an individual home.

Therefore, higher performance is required of a printer from the viewpoint of media flexibility and an environment of use.

However, the sheet attracting type in-line apparatus that attracts a sheet on a transfer belt and multiply transfers an image on the sheet has a problem in that it is susceptible to an influence of an environment where it is placed or a type of a sheet. This is because the sheet attracting type in-line apparatus is required to transfer an image on an sheet having an unstable element of resistance and to attract the sheet on an object being a transfer belt to transfer an image four times thereon.

Extremely high transfer voltage is required in order to make a transfer current to flow particularly at the time of automatic double-side printing when a sheet, which has been subject to fixing once and from which moisture has been evaporated to have high resistance, is fed again, or at the time of an OHT mode for printing on a transparent film that is insulating in the thickness direction.

In addition, since a sheet or a transfer belt receives a transfer charge for applying charge-up when transfer is received at an upstream station, an in-line method apparatus using a transfer belt requires a higher transfer voltage if transfer is received at more downstream station.

In a transfer section, a discharge is generated among a photosensitive body (OPC), a sheet, a transfer belt and a transfer material to transfer toner and give a charge to the sheet. If a transfer voltage is high, a charge defect or the like of a photosensitive body occurs due to an excessive discharge, an abnormal discharge, scattering of toner or transfer charge among them.

That is, if there is a leak site or the like between the transfer material and the transfer belt, image scattering occurs because a discharge is concentrated there. More specifically, a discharge mark of a stripe shape or a polka dot shape occurs on an image. This occurs markedly if there is a localized low resistance region on a material surface, and is caused by an extreme current flowing to the low resistance region.

In addition, if a transfer material surface is even, a discharge threshold value between the transferring member and the transfer belt increases and a voltage between gaps in a separation step at a transfer nip exit becomes higher, thus a discharge amount of one discharge becomes larger. Therefore, an image defect tends to occur.

In addition, in a reversal developing system, charge given to a photosensitive body varies according to a difference of electric potential contrasts viewed from a transferring member with respect to a dark portion potential and a light portion potential on a photosensitive body. A transfer charge with a polarity opposite that of a charged electric potential of the photosensitive body is given to a dark portion potential section where a transfer contrast is greater. Thus, there is also a problem such as a charge defect and a drum ghost due to an insufficient photosensitive body electric potential at the time of the next image formation.

SUMMARY OF THE INVENTION

The present invention has been devised in view of the above problems, and it is an object of the present invention to provide an image forming apparatus that restrains change in a transfer current and prevents an image defect.

It is another object of the present invention to provide an image forming apparatus that comprises an image bearing body for bearing a toner image; a conveying member for bearing to convey a recording material; and a transferring member for transferring the toner image on the image bearing body to the recording material conveyed by the conveying member by being applied thereon, wherein the transferring member has ion conductivity.

Other objects of the present invention will be apparent from the following description.

BRIEF DESCRIPTION OF THE DRAWINGS

In the accompanying drawings.

DESCRIPTION OF THE PREFERRED EMBODIMENTS

Embodiments in accordance with the present invention will be hereinafter described in detail with reference to the accompanying drawings.

First Embodiment

Figure 1:
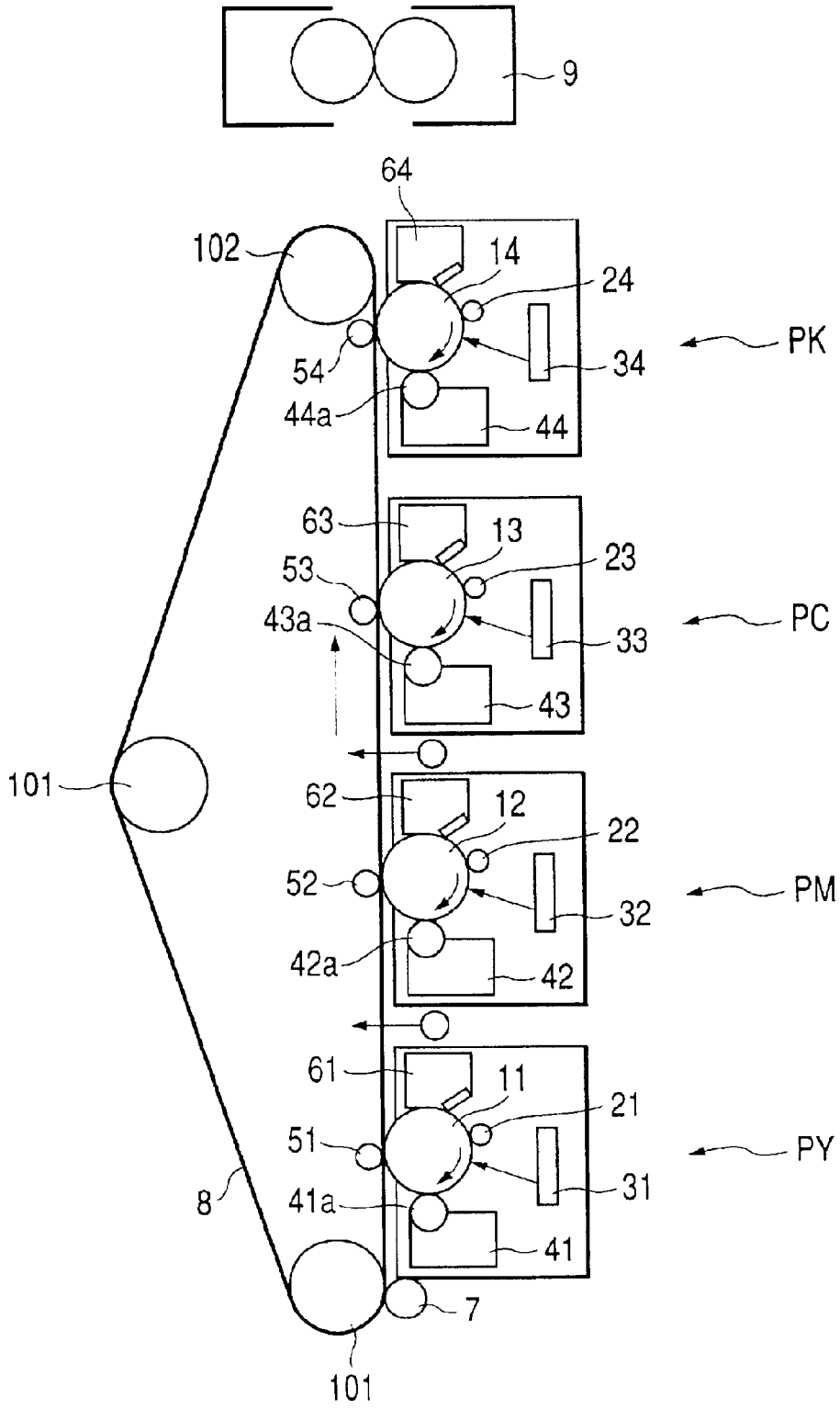
FIG. 1 is a sectional view showing an image forming apparatus that is an embodiment of the present invention.

FIG. 1 is a sectional view showing an embodiment of an image forming apparatus of the present invention.

The apparatus is formed as a full color image forming apparatus of an in-line method which is used as a copying machine, a laser printer or the like. In this image forming apparatus, four independent image forming stations PY, PM, PC and PK for colors of yellow (Y), magenta (M), cyan (C) and black (K) are vertically arranged in a line, which include photosensitive drums, developing devices, drum cleaners or the like. A full color image is realized on a sheet by conveying a recording material, for example a sheet, as a recording medium to these stations by a transfer belt 8 to transfer an image thereon.

The stations PY, PM, PC and PK are provided with electrophotographic photosensitive bodies of a rotary drum type, that is, photosensitive drums 11, 12, 13 and 14, as image bearing bodies, and are driven to rotate at a predetermined peripheral velocity (process speed) clockwise as shown by an arrow in the figure.

The photosensitive drums 11, 12, 13 and 14 are equally applied charge processing by primary chargers 21, 22, 23 and 24 in the respective stations to have predetermined polarity and electric potential on their surfaces during rotation. Then, the photosensitive drums 11, 12, 13 and 14 receive image exposure light from image exposing means 31, 32, 33 and 34 (which are composed of laser diodes, polygon scanners, lenses and the like). Thus, first, second, third and fourth color component images that are object color images, that is, electrostatic latent images corresponding to yellow, magenta, cyan and black component images, respectively, in this embodiment are formed on the photosensitive drums 11, 12, 13 and 14.

Subsequently, the electrostatic latent images on the photosensitive drums 11, 12, 13 and 14 are developed by developing units 41, 42, 43 and 44 in the respective stations. The developing units 41, 42, 43 and 44 contain yellow, magenta, cyan and black toner, respectively, that does not include a magnetic substance (known as nonmagnetic toner). The developing units 41, 42, 43 and 44 develop latent images on the photosensitive drums 11, 12, 13 and 14 by a nonmagnetic one-component contact developing method to visualize them as yellow, magenta, cyan and black toner images. During development, sleeves 41*a*, 42*a*, 43*a* and 44*a* of the developing units 41, 42, 43 and 44 are rotated by a rotation driving apparatus (not shown) and positioned to oppose the photosensitive drums 11, 12, 13 and 14, respectively.

In this embodiment, as a representative example, latent images are developed by a reversal developing method to form images using toner with negative potential of electrification at a developing potential of −400 V while a dark portion potential is −700 V and a light portion potential is −130 V in the photosensitive drums 11, 12, 13 and 14.

The transfer belt 8 being a recording material conveying member of an endless belt shape is tucked up around three rollers, that is, two follower rollers 101 and one driving roller 102, and formed into a vertical track having a straight part along the image forming stations PY, PM, PC and PK. In this way, the transfer belt 8 is driven to rotate at the same process speed as the photosensitive drums 11, 12, 13 and 14 in a direction indicated by an arrow.

A sheet being a recording material is fed from a sheet cassette (not shown) in response to image formation on the photosensitive drums 11, 12, 13 and 14. The sheet passes through a registration roller, and then passes through an attracting nip composed of the transfer belt 8 and an attracting roller 7 to be electrostatically attracted on the surface of the transfer belt 8.

The attracting roller 7 is formed by molding solid rubber in a roller shape on a core bar. A high voltage bias for attraction, that is, an attracting bias is applied on the core bar from a high voltage power source (not shown). In this embodiment, EPDM rubber is molded, a resistance of which is adjusted by dispersing carbon black over a core bar having a diameter of 6 mm, to form the attracting roller 7 as a solid rubber roller having a diameter of 12 mm. A value of resistance of this roller is $10^5\Omega$ when it is measured under the condition that a metal foil of 1 cm width is wrapped around the circumference of the roller and a voltage of 500 V is applied between the metal foil and the core bar.

An attracting bias is generated from a high voltage substrate, which is provided in the high voltage power source, by a signal determined by a DC controller based on an environment in which an apparatus main body is used or printing conditions. A voltage and a current of the attracting bias can be monitored by an A/D converter on the high voltage substrate.

The sheet attracted on the transfer belt 8 is conveyed by the transfer belt and passes through the image forming stations PY, PM, PC and PK one after another. Transfer rollers 51, 52, 53 and 54 being transferring members are arranged opposing the photosensitive drums 11, 12, 13 and 14, respectively, on a back side of the transfer belt 8. Toner images are multiply transferred on the sheet one after another by the respective transfer rollers, to which a transfer bias of positive polarity is applied, every time it passes through each station. Thus, a full color image, in which toner images of four colors, namely yellow, magenta, cyan and black are superimposed, is formed on the sheet. After the toner images are transferred, residual toner is cleaned from the photosensitive drums 11, 12, 13 and 14 by respective cleaners 61, 62, 63 and 64. That is, each photosensitive drum and each transfer roller oppose each other with the transfer belt between them, and the plurality of photosensitive drums and the plurality of transfer rollers are arranged in the conveying direction of the transfer belt.

The sheet having the toner images of four colors multiply transferred thereon is separated from the transfer belt 8 at its top end by curvature and sent to a roller fixing device 9 thereafter. The toner images are fixed on the sheet in the roller fixing device 9, and then discharged outside the machine as a final full color print image.

In a double-side mode for automatically printing on both sides of a sheet, a sheet that has passed through the fixing device 9 is once guided to an automatic double-side printing unit (not shown), where the front and the back of the sheet are reversed. The sheet is then sent to a feeding unit again, and an image is formed on the back side of the sheet which is now the front side.

In this embodiment, the transfer belt 8 consists of a sheet of an ion conductive resin material, a resistance of which is adjusted to a volume resistance value of $10^9$ Ωcm by adding an ion conductive agent to PVDF (polyvinylidene fluoride) resin. The transfer belt 8 has a single layer structure with the thickness of 100 μm.

In the present invention, a volume resistance value is a value obtained by measuring a resistance under an applied voltage of 100 V by a high resistance meter R8340 manufactured by Advantest Corporation using a measurement probe in compliance with the JIS rule K6911, and dividing the measured value by a thickness of a belt to convert it to a normal value per unit.

In this embodiment, an upper limit volume resistance value of $10^{12}$ Ωcm is set for the transfer belt 8 from the viewpoint of realizing self-attenuation and securing sufficient sheet attraction.

It is desirable that the volume resistance value of the transfer belt 8 is high from the viewpoint of electrostatically attracting a sheet. However, if the volume resistance value reaches $10^{12}$ Ωcm or more, an attenuation of electric potential which occurs while a transfer belt moves between stations, which is known as self-attenuation, cannot be expected, and the transfer belt itself is applied charge-up. Thus, a high transfer voltage is required or destaticizing means such as a corona charger for destaticizing the transfer belt is separately required, which is not desirable for simplifying an apparatus and reducing costs.

Therefore, when attempting to set a resistance value of a transfer unit high due to various factors, it is desirable to set volume resistance value high not only for the transfer belt 8 but also for the transfer rollers 51 to 54.

A high resistance value can be set in a transfer roller, unlike a transfer belt, even if a material of lower volume resistance value is used, and it is possible to establish a transfer system with a high resistance without charge-up.

The transfer roller used in this embodiment will be described.

As the transfer rollers 51 to 54, a single layer roller having a core bar diameter of 6 mm and an external diameter of 12 mm is used. The material of the roller is a mixture of epichlorohydrin rubber in NBR rubber. The rubber mixture is extruded in a roller shape and ground to have a finished transfer roller.

Measurement of a resistance of a transfer roller is defined by a measurement of a resistance value by an R8340A resistance meter manufactured by Advantest Corporation at the time when each voltage is applied between a core bar and a metal tape having the width or 10 mm which is wound around the roller. The measurement is performed at three parts, namely parts 20 mm from each of the left and the right ends of the roller as well as a central part, and measured values are averaged. In this embodiment, a resistance value is measured under the condition that a voltage of 500 V is applied between the metal tape and the core bar, and the resistance value is set at $5\times10^{7}\Omega$.

Figure 2:
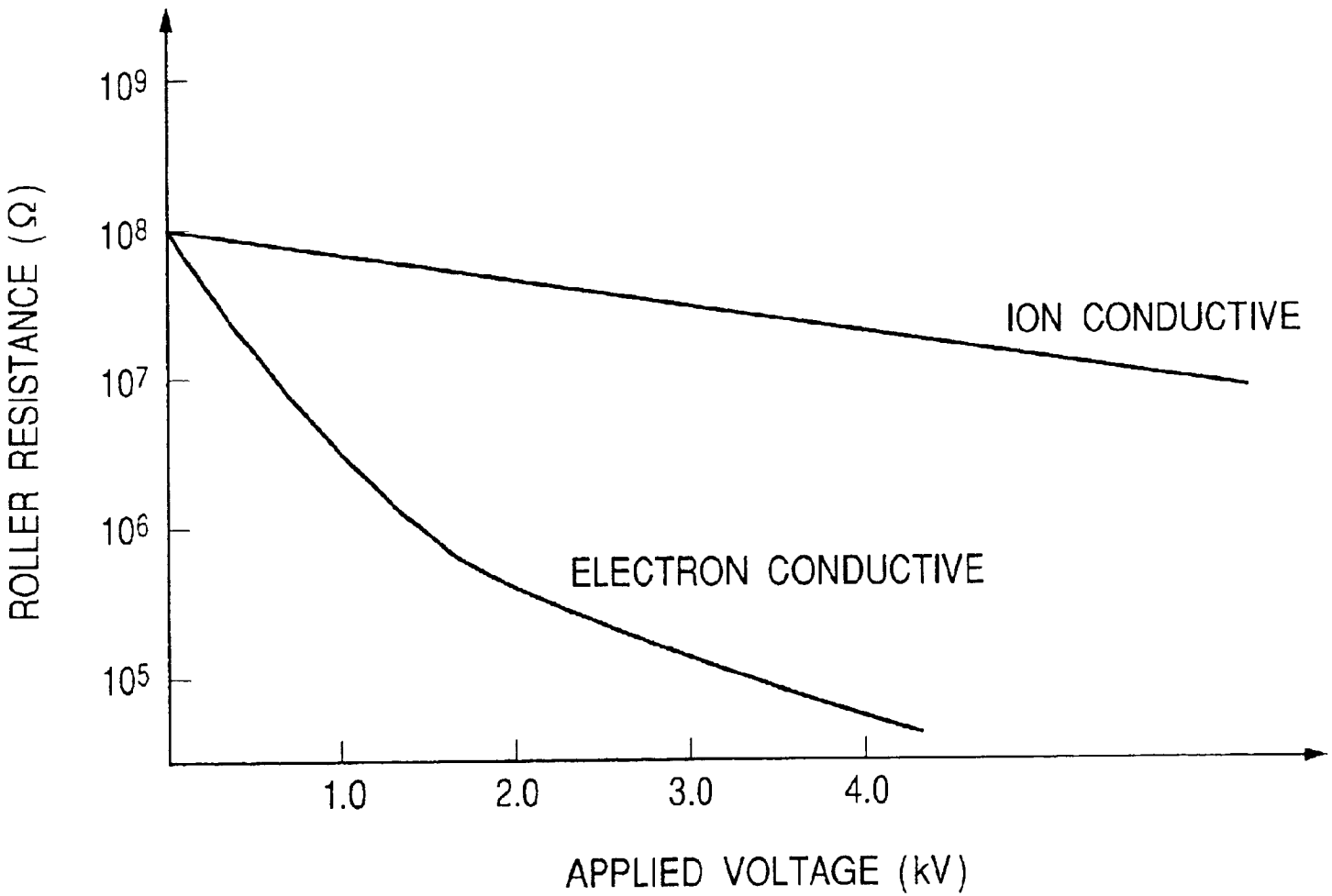
FIG. 2 is a diagram showing a relation between an applied voltage and a roller resistance.

The mixture of NBR rubber and epichlorohidrin rubber has a conductive form of ion nature(ion conductivity) and does not have local unevenness of resistance because a resistance value of the entire roller is determined by a specific resistance value of a material. In addition, since a material contributing to conductance is ion, which is a characteristic of the ion conductivity, the mixture has an advantage in that a variation of resistance value due to applied voltage is small as shown in FIG. 2.

A conventional transfer roller takes an electronic conductive form (electron conductivity) securing a conductivity by dispersing a filler such as carbon black and meal oxide over a roller material. However, since local unevenness of resistance is likely to occur due to uneven dispersion of the filler. Thus, if a transfer voltage is particularly high, a part where the filler is concentrated becomes a leak site through which a large volume of current may easily flow.

In addition, a conductive form of electronic conductivity caused by an electron hopping to move between fillers due to a tunnel effect. Thus, as shown in FIG. 2, the electron conductivity has a characteristic that a current tends to flow suddenly when an applied voltage becomes high, and a resistance value decreases.

An electron conductive transfer roller that is generally used shows a variation of a resistance value in the order of 1.5 digit in the voltage range of 1000 to 3000 V, and easily makes excessive currents flow because a resistance value becomes extremely low in a high voltage area. On the other hand, a variation of a resistance value of an ion conductive transfer roller is within 1 digit in the voltage range of 1000 to 3000 V.

These ion conductive and electron conductive characteristics can be represented as whether or not a characteristic of resistance versus applied voltage shown in FIG. 2 has linearity, therefore whether or not a characteristic of current versus applied voltage has linearity.

As described above, in an in-line method image forming apparatus, a sheet or a transfer belt is applied charge-up in a downstream station due to a transfer charge given in an upstream station. Thus, it is necessary to increase a transfer voltage in order to make a same amount of transfer current flow, which tends to cause an image defect due to an abnormal discharge. Such a phenomenon is particularly evident at the time of double-side printing that has a high resistance of a recording material and requires higher transfer voltage, and at the time of OHT printing that is a resin mode.

As an example, in a printer of an intermediate transfer type that once superimposes toner images of respective colors formed by image forming stations on a belt or an intermediate transferring member of a drum shape and finally transfers a full color image on a recording material collectively, a transfer voltage at the time of double-side printing is approximately 2 kV. With this, an image of a same quality can be realized with the printer regardless of whether the printer employs a conductive form of electron conductivity or ion conductivity. On the other hand, although a transfer voltage at the time of double-side printing in a printer of an in-line method of a transfer belt type is 2 kV in a station for a first color, which is sufficient, a station for a last fourth color requires 3 kV. This indicates that a recording material or a transfer belt is applied charge-up by 1 kV.

If a transfer roller of electron conductivity is used in such a voltage, discharge is concentrated in a partial leak site on the roller, and an image defect of a stripe shape or a polka dot shape occurs. In addition, during reversal developing, a large amount of transfer current flows into a non-image part corresponding to a dark portion potential part and a sheet-unpassing part (in particular, a sheet-unpassing part at the time of feeding small size recording material) to cause an image defect due to a charge defect of an OPC photosensitive body.

On the other hand, in a transfer roller of an ion conductivity employed in this embodiment, an electrically minute leak site does not exist on a roller surface even if a transfer voltage of 3 kV is applied in a last station, and a current versus voltage characteristic is linear. Therefore, an excessive current does not flow into a dark portion potential part with large transfer contrast and a small size recording material sheet-unpassing part, thus an image defect of a stripe shape or a polka dot shape, or an image defect due to a photosensitive body charge defect does not occur.

In order to limit the flow of a transfer current into a sheet-unpassing part, it is necessary to reduce an impedance between a sheet-passing part and a sheet-unpassing part compared with that of a transfer roller being a transferring member. Thus, it is necessary to set a resistance value of a transfer roller higher than a certain value. In the case of a conventional transfer roller of electron conductivity, since a resistance value decreases in a high voltage area, it is necessary to set a resistance value of $10^{8}\Omega$ or more for the transfer roller. On the other hand, in the case of a transfer roller of ion conductivity as in this embodiment, it is sufficient to set a resistance value at $10^7\Omega$ or more under the same condition.

Further, in order to make a current required for transfer (e.g., in the order of 10 $\mu$A) using a practical high voltage power source (e.g., a maximum voltage of 10 kV), it is desirable to limit a resistance value of a transfer roller to $10^9\Omega$ or less. That is, a resistance value of a transfer roller at a voltage of 100 V applied to the transfer roller is $10^7$ to $10^9\Omega$.

As described above, in this embodiment, a transfer roller as a transferring member is formed of an ion conductive material that has small partial unevenness of resistance and can reduce a change of a transfer current with respect to a transfer potential contrast in an image forming apparatus of an in-line method using a transfer belt. Thus, an abnormal discharge during transfer can be prevented, particularly at the time of double-side printing and OHT printing when a transfer voltage increases, and an image defect of a stripe shape or a polka dot shape due to an abnormal discharge can be prevented.

Second Embodiment

Figure 3:
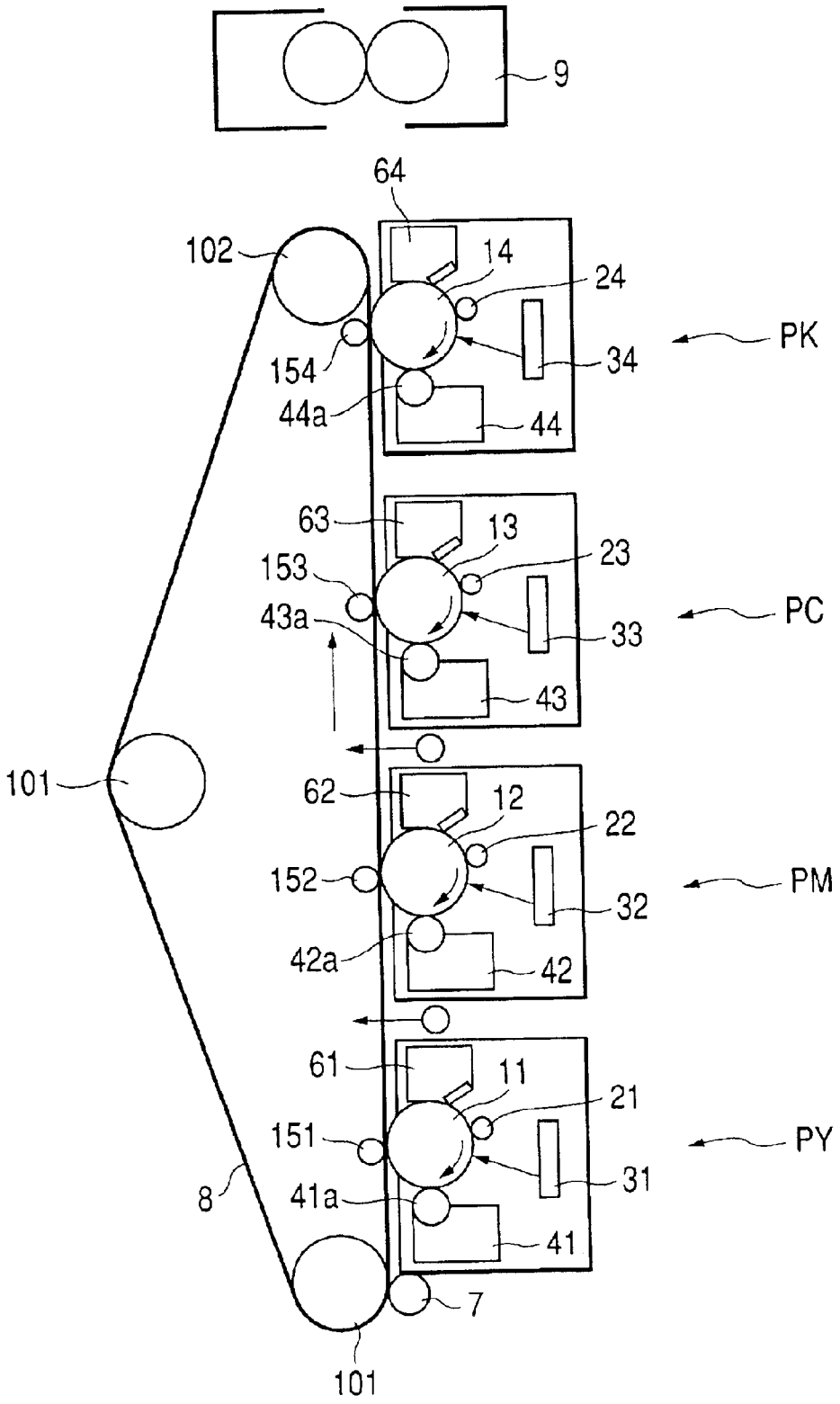
FIG. 3 is a sectional view showing an image forming apparatus that is another embodiment of the present invention.

This embodiment is characterized in that an image defect due to an applied high transfer voltage is prevented by using a member with an uneven surface such as a sponge in transfer rollers 151 to 154 as transferring members in an image forming apparatus of an in-line method in which a transfer belt of FIG. 3 is used. Since a basic configuration of the image forming apparatus in this embodiment is the same as the apparatus of FIG. 1, descriptions of identical parts are hereinafter omitted.

As described in the first embodiment, the in-line method has a problem in that, since a recording material is applied charge-up, it is necessary to set a transfer bias of a downstream station high, thus an image defect tends to occur.

A maximum voltage in double-side printing is in the order of 3 kV even in the in-line method, and an image defect can be prevented by using a transfer material of ion conductivity. However, a transfer voltage required for an OHT film, which is almost insulating in the thickness direction, may be as high as 6 kV or more.

Reasons for the above are as follows. An OHT film is generally applied resistance processing on its surface as a means for preventing an image defect due to a peeling discharge, and a base film of the OHT is an insulator such as PET and has a thickness of 100 $\mu$m or more. Thus, a voltage required for transfer is accordingly high and charge-up is intense, which is an extremely difficult condition in view of a transfer bias in a downstream station and an image defect.

In this embodiment, as described above, an image defect at the time of printing on an OHT is prevented by using a sponge roller of ion conductivity as the transfer rollers 151 to 154 being transferring members.

If a surface of a transfer roller is even, a threshold value for starting a discharge between the transfer roller and a back of a transfer belt is high. This is because, as proved in discharge theories such as Paschen's law, a discharge starting voltage (discharge threshold value) depends entirely on an atmospheric pressure and an electric field intensity between the transfer roller and the transfer belt. That is, since an electric field between flat electrodes is a parallel electric field (equal electric field), a discharge threshold value between them becomes the highest. In a separating process in which both the transfer roller and the transfer belt rotate and move, since a voltage between gaps becomes extremely high, a discharge is always excited at a general transfer voltage regardless of discharge threshold value.

When a discharge occurs in the state in which a threshold value is high such as between even surfaces, since a charge volume moved by one discharge is extremely large, a charge balance on a back of a recording material tends to collapse. In addition, since a discharge shock is also large, an image defect of a stripe shape or a polka dot shape tends to occur. In addition, when a recording material is an OHT, an exploded image or the like markedly occurs due to inequality of a charge in the back of a recording material.

On the other hand, in the case of a transfer roller with a sponge-like surface as in this embodiment, there are uncountable number of unevenness on the surface of the transfer roller, which generate an unequal electric field. Thus, a discharge threshold value decreases and a charge displacement for each discharge becomes small. That is, since charge is transferred by many minute discharges, a discharge that is so large as to cause an image defect can be prevented even with a same transfer current.

In this embodiment, a sponge roller of ion conductivity was manufactured by mixing NBR rubber and epichlorohydrin rubber, extruding the mixed rubber material into a tubular roll, and vulcanizingly foam the extruded material under a pressurized atmosphere.

The sponge roller manufactured in this way had a core bar diameter of 6 mm, an external diameter of 12 mm and a product hardness of 30° (Asker C hardness; measured under the weighting of 500 g), and an actual resistance value measured by the above-mentioned measuring method was $10^8\Omega$ and a cell diameter of the sponge surface was approximately 100 $\mu$m. In addition, surface roughness of the roller measured by a non-contact surface roughness meter was 40 $\mu$m for Ra. A surface roughness of the transfer roller is preferably 10 $\mu$m or more.

Images were printed on an OHT using this sponge roller for transfer on the OHT as each of the transfer rollers 151 to 154 of the first to fourth stations PY to PK of the image forming apparatus shown in FIG. 3. An OHT print mode was realized by switching a transfer voltage applied onto the transfer rollers from a high voltage power source by a command to the image forming apparatus from a host computer.

For comparison, images were printed on an OHT by applying transfer voltages of 2 kV, 3.5 kV, 5.0 kV and 6.5 kV in this order from the upstream station using a solid roller of electron conductivity as a transfer roller. As a result, extreme image scattering and paper marks on a sheet unpassing part occurred.

On the other hand, when a sponge roller of ion conductivity of this embodiment was used, a favorable images could be realized on an OHT by the application of transfer voltages under the same conditions, i.e., 2 kV, 3.5 kV, 5.0 kV and 6.5 kV from the upstream station in this order.

As described above, in this embodiment, a transfer roller of a sponge or the like having ion conductivity and an uneven surface is used as a transferring member. Thus, a transfer charge can be moved by generating many small discharges, while restraining an excessive discharge in a transfer requiring high voltage such as OHT printing, and it is possible to prevent an image defect of a stripe shape or a polka dot shape due to an abnormal discharge.

Note that a transfer roller may be configured to have a sponge layer at least on its surface.

In any of the above-mentioned embodiments, a transfer roller is used as a transferring member, that is, a transferring member of a roller shape is used. However, a transferring member in the form of a brush, a blade or the like may be used as long as the transferring member is the one which contacts a back side of a transfer belt in a position opposing an image bearing body such as a photosensitive drum, gives a transfer charge to a recording material on the transfer belt by a transfer bias applied by a high voltage power source, and transfers a toner image on the image bearing body on the recording material.

Note that a printer of an in-line method generally has image forming stations for different colors arranged horizontally. With such a configuration, there is a problem in that an apparatus occupies a large area for installation, and a requirement for a smaller apparatus in an office cannot be satisfied.

In addition, an optical element such as a laser scanner is disposed over an apparatus main body. Thus, it is difficult to make the top of the apparatus main body open to access a sheet conveying path or expendable parts for the apparatus and to change toner or a photosensitive drum, and it is difficult to handle sheet jam.

On the other hand, an area for installing an apparatus can be reduced by arranging a plurality of image forming stations vertically as indicated in the above-mentioned embodiment. Moreover, handling of jam and changing of expendable parts can be made easier by dividing an apparatus main body vertically along a sheet conveying path.

As described above, according to the present invention, since a transferring member such as a transfer roller is formed of an ion conductive material in an image forming apparatus of an in-line method in which a transfer belt is used, partial resistance unevenness becomes less and change of a transfer current with respect to a transfer potential can be reduced in a transfer material. Therefore, at the time of double-side printing or OHT printing when a transfer voltage increases, an abnormal discharge and an image defect of a stripe shape or a polka dot shape due to the abnormal discharge can be prevented. Moreover, if a surface of a transferring member is formed of an uneven material such as a sponge, an excessive discharge is restrained even more and the prevention of an image defect can be further improved.

As many apparently widely different embodiments of the present invention can be made without departing from the spirit and scope thereof, it is to be understood that the invention is not limited to the above-described specific embodiments thereof except as defined in the appended claims.

What is claimed is:

1. An image forming apparatus comprising:

an image bearing member for bearing a toner image;

a conveying member for bearing and conveying a recording material; and a transferring member for transferring a toner image on said image bearing member to the recording material conveyed by said conveying member by being applied a voltage;

wherein said transferring member has ion conductivity, and a change in a resistance value of said transferring member under a voltage of 1000 to 3000 V applied to said transferring member is within one digit.

2. An image forming apparatus comprising:

an image bearing member for bearing a toner image;

a conveying member for bearing and conveying a recording material; and a transferring member for transferring a toner image on said image bearing member to the recording material conveyed by said conveying member by being applied a voltage;

wherein said transferring member has ion conductivity, and a resistance value of said transferring member under a voltage of 1000 V applied to said transferring member is $10^7$ to $10^9\Omega$.

3. An image forming apparatus comprising:

an image bearing member for bearing a toner image;

a conveying member for bearing and conveying a recording material; and a transferring member for transferring a toner image on said image bearing member to the recording material conveyed by said conveying member by being applied a voltage;

wherein each of said transferring member and said conveying member has ion conductivity.

4. An image forming apparatus according to any one of claims 1–3, wherein a surface roughness of said transferring member is at least 10 $\mu$m.

5. An image forming apparatus according to any one of claims 1–3, wherein said transferring member has a sponge at least on surface thereon.

6. An image forming apparatus according to any one of claims 1–3, wherein said image forming apparatus has a double-side mode for forming images on both sides of a recording material.

7. An image forming apparatus according to any one of claims 1–3, wherein said image forming apparatus has a resin mode for forming an image on a recording material made of resin.

8. An image forming apparatus according to claim 7, wherein said recording material made of resin has light permeability.

9. An image forming apparatus according to any one of claims 1–3, further comprising developing means for developing a latent image on said image bearing member by a reversal developing method.

10. An image forming apparatus according to any one of claims 1–3, wherein the number of said image bearing member and the number of said transferring member are plural respectively, corresponding to plural color toners, and said image bearing member and said transferring member oppose to each other via said conveying member.

11. An image forming apparatus according to claim 10, wherein said plural image bearing members and said plural transferring members are arranged in a conveying direction of said conveying material, and plural color toner images are multiply transferred on a recording material one after another by a conveyance of said conveying member.

12. An image forming apparatus according to any one of claims 1–3, wherein said conveying member has an endless shape.

13. An image forming apparatus according to claim 3, wherein a change in a resistance value of said transferring member under a voltage of 1000 to 3000 V applied to said transferring member is within one digit.

14. An image forming apparatus according to claim 3, wherein a resistance value of said transferring member under a voltage of 1000 V applied to said transferring member is $10^7$ to $10^9$ U.

15. An image forming apparatus according to any one of claims 1, 2, or 3, wherein said transferring member is a roller, and said conveying member is a belt.

* * * * *

UNITED STATES PATENT AND TRADEMARK OFFICE

CERTIFICATE OF CORRECTION

PATENT NO. : 6,801,743 B2
DATED : October 5, 2004
INVENTOR(S) : Hideyuki Yano

It is certified that error appears in the above-identified patent and that said Letters Patent is hereby corrected as shown below:

Column 1,
Line 57, "an" (2nd occurrence) should read -- a --.

Column 4,
Line 17, "or" should read -- for --.

Column 8,
Line 49, 'images" should read -- image --.

Column 10,
Line 42, "to" should be deleted.

Signed and Sealed this

Twenty-fifth Day of January, 2005

JON W. DUDAS
*Director of the United States Patent and Trademark Office*